United States Patent [19]

Lembke et al.

[11] 4,295,452

[45] Oct. 20, 1981

[54] FUEL INJECTION SYSTEM

[75] Inventors: Manfred Lembke, Gerlingen; Heinrich Knapp, Leonberg, both of Fed. Rep. of Germany

[73] Assignee: Robert Bosch GmbH, Stuttgart, Fed. Rep. of Germany

[21] Appl. No.: 45,894

[22] Filed: Jun. 6, 1979

[30] Foreign Application Priority Data

Jul. 1, 1978 [DE] Fed. Rep. of Germany ..... 2829057

[51] Int. Cl.[3] ..... F02M 53/04

[52] U.S. Cl. ..... 123/470; 123/469; 239/533.2; 239/587; 285/226

[58] Field of Search ..... 285/226, 158, 229, 422; 123/139 AW, 469, 470, 471, 468; 239/600, 551, 533.2, 587

[56] References Cited

U.S. PATENT DOCUMENTS

| | | | |
|---|---|---|---|
| 2,232,656 | 2/1941 | Davis | 285/422 |
| 2,407,745 | 9/1946 | Jacobson | 285/226 |
| 2,702,079 | 2/1955 | Smith | 239/600 |
| 3,357,678 | 12/1967 | Dyki | 285/158 |
| 3,412,718 | 11/1968 | Long | 123/139 AW |
| 3,431,895 | 3/1969 | Bailey | 123/470 |
| 4,143,625 | 3/1979 | Kulke | 123/470 |

*Primary Examiner*—Charles J. Myhre
*Assistant Examiner*—Carl Stuart Miller
*Attorney, Agent, or Firm*—Edwin E. Greigg

[57] ABSTRACT

A fuel injection system is proposed which serves to supply fuel to a mixture-compressing, externally ignited internal combustion engine in accordance with operational parameters of the engine. The fuel injection system includes a metallic fuel distributor tube, which communicates via at least one branch line with at least one fuel injection valve, wherein the branch line is embodied as a metal tube and is connected with the fuel injection valve by means of a threaded assembly. The material used for the branch line is easily bendable metal. Between the threaded assembly at the branch line and the fuel injection valve, a thin-walled metallic bellows is provided, by means of which a lateral displacement between the attachment point of the branch line at the fuel distributor tube and the installation point of the fuel injection valve is compensated for, and the noise of operation produced by the fuel injection valve is damped.

6 Claims, 3 Drawing Figures

FUEL INJECTION SYSTEM

BACKGROUND OF THE INVENTION

The invention relates to a fuel injection system of the type which includes a metallic distributor tube which is in communication via at least one branch line provided with at least one fuel injection valve. A fuel injection system is already known in which the fuel injection valves are connected to the fuel distributor tube via short hose couplings, which are secured to the injection valve by means of clamping rings. This results in the disadvantage that problems arise with the seal at the transition between hose and fuel distributor tube on account of aging of the hose, caused by particularly great temperature stress and temperature changes. There is also the danger of damaging the hose structure at the outset by the improper application of the hose clamping rings, which causes premature aging of the hose material. Furthermore, it is imperative, for safety reasons, that a particularly high-grade hose quality be utilized at this junction point. Finally, the hose connection itself represents a large safety risk because of the danger of fire.

OBJECT AND SUMMARY OF THE INVENTION

The fuel injection system as explained in detail hereinafter and finally claimed has the advantage over the prior art that the connection between the fuel distributor tube and the fuel injection valves is resistant to high temperatures and to temperature change, while simultaneously providing for a tight connection by means of the threaded assembly.

Further advantageous embodiments and improvements of the fuel injection system of the main claim are possible by means of the characteristics recited in the dependent claims. Of particular advantage is the concept of providing the branch lines out of an easily bendable metal. It is also advantageous to dispose a thin-walled metallic bellows between the threaded assembly and the injection valve which on one side is connected to a projection of the fuel injection valve and on the other side to a connecting body which acts as a part of the threaded assembly.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
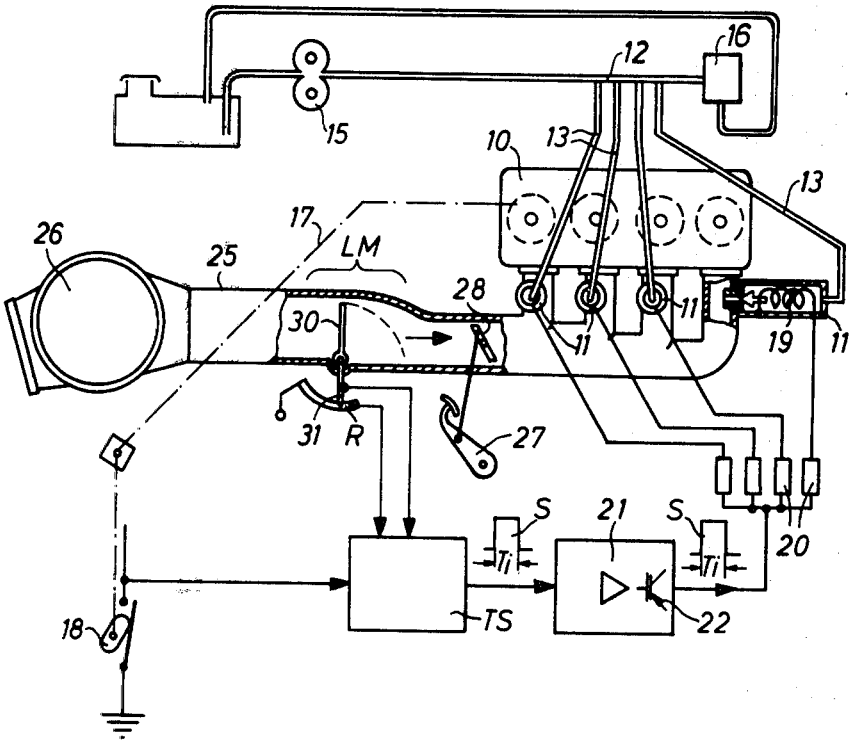
FIG. 1 is a diagrammatic illustration of an electrically controlled fuel injection system.

Turning now to the drawings in FIG. 1, an electrically controlled fuel injection system is shown for operating a four-cylinder, four-cycle internal combustion engine 10, which includes as its essential components four electromagnetically actuatable fuel injection valves 11, to which the fuel to be injected is supplied via a metallic fuel distributor tube 12 and branch lines 13; an electromotor-driven fuel supply pump 15; a pressure regulator 16, which regulates the fuel pressure to a constant value; and an electronic control apparatus to be described in detail below which is triggered twice upon each camshaft rotation by means of a signal transducer 18 coupled to the camshaft 17 of the engine and then delivers a rectangular electrical opening pulse S to each of the fuel injection valves 11. The time interval $T_i$ of the opening pulses as indicated in the drawing of FIG. 1 determines the opening duration of the fuel injection valves and accordingly that quantity of fuel which during a particular opening period leaves the inner chamber for the fuel injection valves 11, which are under a practically constant fuel pressure of 2 atmospheres. The magnetic coils 19 of the fuel injection valves are each connected in series to a decoupling resistor 20 and attached to a common amplifier and output stage 21, which has at least one output transistor 22, which with its emitter-collector path is disposed in series with the decoupling resistors 20 and the magnetic coils 19, the latter being connected at one side to ground.

In mixture-compressing engines having external ignition, as shown, the fuel quantity which can be completely consumed during the working stroke is ascertained by means of the induced air quantity taken into each of the cylinders during the individual intake stroke preceding the working stroke. In order to utilize the engine appropriately, it is also necessary that there be no substantial air excess present after the working stroke. In order to attain the desired stoichiometric ratio between induced air and fuel, an air flow rate meter LM is provided in the intake manifold 25 of the engine, behind its filter (viewing in the direction of flow) but ahead of its throttle valve 28 which can be adjusted by a gas pedal 27. The air flow rate meter LM essentially comprises a baffle valve 30, acting counter to a spiral spring which is not shown, and a variable resistor R, whose adjustable pickup 31 is coupled with the baffle valve. The air flow rate meter LM cooperates with a transistorized circuit TS, which at its output delivers the control pulses S for the output stage 21.

Figure 2:
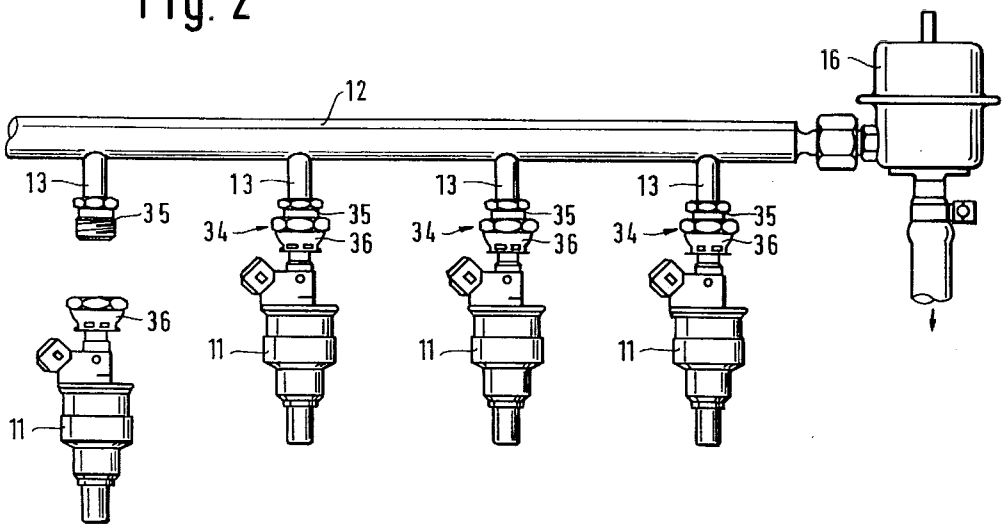
FIG. 2 is a fragmentary detailed view of the fuel injection system showing a fuel distributor tube and fuel injection valves.

In FIG. 2, in a detail of the fuel injection system of FIG. 1, the fuel distributor tube 12 is shown with the branch lines 13 and the fuel injection valves 11. In accordance with the invention, the branch lines are of metallic material, particularly an easily bendable material such as copper, and are soldered or welded to the fuel distributor tube 12. As a result of the embodiment of the branch lines 13 being made out of an easily bendable metal, any possible lateral displacement between the particular attachment of the branch line 13 at the fuel distributor tube and the installation point of the fuel injection valve 11 which may arise from twisting of the branch lines during mounting of the injection valves on the engine is compensated for, all of which will be understood by those skilled in the art. The connection between the particular branch line 13 and the associated fuel injection valve 11 is preferably accomplished by means of a screw attachment 34. The screw attachment 34 is advantageously embodied by a threaded projection 35 connected with each branch line 13 and by a sleeve nut 36 coupled to each fuel injection valve 11.

The embodiment of the fuel injection system in accordance with the invention thus presents the advantage that it is resistant to high temperatures and to temperature change in that it presents as small a safety risk as possible because of the absolutely tight screw connection, and that tolerances in the installation position of the fuel injection valves 11 can be compensated for by means of easily bendable branch lines 13.

Figure 3:
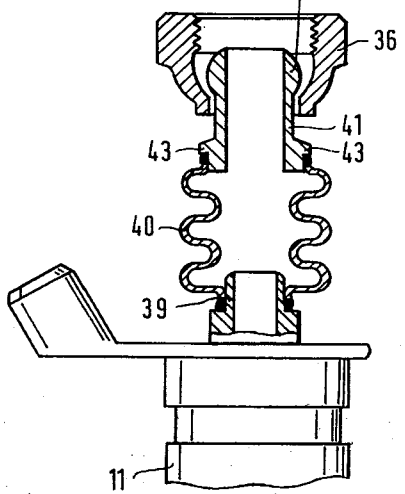
FIG. 3 is an enlarged cross-sectional view of a portion of the threaded assembly and the bellows.

In FIG. 3, a second exemplary embodiment of a connection between the branch lines 13 shown in FIG. 2 and the fuel injection valves 11 is shown. Here, the fuel injection valve 11 is provided with a projection 39, with which a metallic, thin-walled bellows 40 is connected. On the other side, the bellows 40 is connected with a connecting body or nipple 41, which has an annular bulge-like protuberance 42. A sleeve nut 36 which has an inner wall that is formed complementally with the area 42 of the nipple is arranged to be tightened and thus grips the body 41.

As the threaded assembly, the sleeve nut 36 cooperates with a threaded projection 35 of the branch line 13. The connecting body 41 may have two flat faces 43 for the purpose of counterholding by a wrench during assembly. In the alternative, this area 43 may be embodied at the same point with four or six faces as desired. The bellows 40 is preferably manufactured out of thin-walled steel and appropriately sealed or welded to the projection 39 of the fuel injection valve 11 and to the connecting body 41. Additionally, as is not shown, the screw attachment 34 may also be so embodied that the threaded projection 35 is connected to the fuel injection valve 11 and the sleeve nut 36 is coupled to the branch line 13. The embodiment of the fuel injection system in accordance with FIG. 3 presents the further advantage over that of FIG. 2 that as a result of the bellows 40, greater tolerances between the installation position of the fuel injection valves 11 and the branch lines 13 can be compensated for, and operational noises produced by the fuel injection valve 11 can be damped out by the yielding ("breathing") of the bellows 40.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for internal combustion engines comprising a metallic fuel distributor tube which is in communication with a pressure regulator and a fuel supply pump, at least one fuel injection valve, at least one fuel branch line made of bendable metal connected at one end to said metallic fuel distributor tube and at its opposite end to at least one fuel injection valve, a threaded assembly for connecting said bendable metal branch line to said fuel injection valve and a thin-walled bellows interposed between said threaded assembly and said fuel injection valve.

2. A fuel injection system in accordance with claim 1, further wherein said bellows has one end means that is securely connected to a nipple element of said threaded assembly.

3. A fuel injection system in accordance with claim 2, further wherein said bellows has another end means securely connected to said fuel injection valve.

4. A fuel injection system in accordance with claim 1, further wherein said bellows is made of metal.

5. A fuel injection system in accordance with claim 1, further wherein said bellows is made of thin-walled steel.

6. A fuel injection system in accordance with claim 1, further wherein said bendable metal is copper.

* * * * *